US005765412A

United States Patent [19]

Koskela et al.

[11] Patent Number: 5,765,412

[45] Date of Patent: Jun. 16, 1998

[54] MULTIPLE BACKSET LOCK

[75] Inventors: Cheryl K. Koskela, Sausalito; Jaime Galindo, Hayward, both of Calif.

[73] Assignee: Schlage Lock Company, San Francisco, Calif.

[21] Appl. No.: 728,279

[22] Filed: Oct. 8, 1996

[51] Int. Cl.[6] ..... E05B 65/06

[52] U.S. Cl. ..... 70/134; 70/370; 70/461; 292/1.5; 292/337

[58] Field of Search ..... 70/447–451, 134, 70/370, 461, 372, 373, 466; 292/1.5, 167, 169, 169.21–169.23, 337, DIG. 60

[56] References Cited

U.S. PATENT DOCUMENTS

| | | | |
|---|---|---|---|
| Re. 34,240 | 5/1993 | Lin | 292/1.5 X |
| 1,661,454 | 3/1928 | Wilson | 70/461 X |
| 2,042,021 | 5/1936 | Schlage | 70/29 |
| 2,673,758 | 3/1954 | Schlage | 292/244 |
| 3,751,953 | 8/1973 | Newman | 70/381 |
| 3,953,991 | 5/1976 | Grossman | 292/1.5 X |
| 3,961,508 | 6/1976 | Crepinsek | 70/370 |
| 4,301,667 | 11/1981 | Best et al. | 70/380 |
| 4,422,677 | 12/1983 | Gater | 292/139 |
| 4,446,707 | 5/1984 | Mullich et al. | 70/134 |
| 4,489,576 | 12/1984 | Mullich et al. | 70/461 X |
| 4,564,229 | 1/1986 | Mullich et al. | 292/169.13 |
| 4,593,542 | 6/1986 | Rotondi et al. | 70/134 |
| 4,602,490 | 7/1986 | Glass et al. | 70/134 |
| 4,643,007 | 2/1987 | Fish et al. | 70/134 |
| 4,656,849 | 4/1987 | Rotondi et al. | 70/134 |
| 4,759,576 | 7/1988 | Ching | 292/1.5 |
| 4,768,817 | 9/1988 | Fann et al. | 292/1.5 |
| 4,793,166 | 12/1988 | Marks | 70/461 X |
| 4,950,008 | 8/1990 | Fang | 292/1.5 X |
| 4,957,315 | 9/1990 | Lin | 70/461 X |
| 4,976,122 | 12/1990 | Doolan et al. | 70/134 |
| 4,979,768 | 12/1990 | Marotto et al. | 70/461 X |
| 5,040,393 | 8/1991 | Rossebo | 70/370 |
| 5,074,605 | 12/1991 | Fann et al. | 292/1.5 X |
| 5,149,151 | 9/1992 | Shen | 292/1.5 |
| 5,257,838 | 11/1993 | Lin | 292/1.5 |
| 5,498,037 | 3/1996 | Fan Lai | 292/1.5 |
| 5,562,314 | 10/1996 | Wheatland et al. | 292/1.5 |
| 5,570,912 | 11/1996 | Mullich | 292/1.5 |

*Primary Examiner*—Suzanne Dino
*Attorney, Agent, or Firm*—Robert F. Palermo; Michael H. Minns

[57] ABSTRACT

A multiple backset door lock assembly with a door lock assembly in which a bolt is coupled to a bolt extension saddle. The bolt extension saddle is provided with two contoured slots, each slot being engagable by a crank and pin assembly actuated either by a key or a thumbturn.

16 Claims, 10 Drawing Sheets

MULTIPLE BACKSET LOCK

FIELD OF THE INVENTION

This invention relates to door locks; more particularly, the invention relates to a door lock assembly which has multiple backsets to accommodate differing lock bore locations typically encountered in the marketplace.

BACKGROUND AND OBJECTS OF THE INVENTION

As those skilled in the art will recognize, "backset" is the distance from the door edge in which a lock assembly (including a bolt) is mounted, to the point where a spindle, is rotated for extending and retracting the bolt. The backset is measured along the axis of the bolt movement and typical industry standards have established at least two common distances, such as 2 ⅛ inches and 2 ¾ inches. To make a door lock assembly that can easily be adapted to at least two standard backset distances, simple assembly by the door lock manufacturer, and simple installation by the user, are essential attributes.

It is therefore an object of the invention to provide a door lock and bolt assembly having as part thereof at least two easily selectable backset dimensions and which is simple, and reliable in operation.

It is another object of the invention to provide a door lock assembly which is reliable in operation once installed and which also exhibits a minimum number of moving parts which simplifies both the construction and operation thereof.

SUMMARY OF THE INVENTION

In accordance with one aspect of the invention, a door lock assembly is provided in which an axially moving bolt is provided with a bolt extension in the form of a saddle, having depending skirts, on both sides of which uniquely contoured slots are formed. The bolt extension saddle is axially guided, and rotationally (about its own axis) secured by a housing guide which is affixed to a bolt housing. The contoured slot, of which there is at least one, preferably two or more, spaced along the axis of the bolt extension, engage a crank pin which rotates with the movement of a key or thumbturn to extend and retract the bolt. Because the bolt is rigidly coupled to the bolt extension saddle, the backset is selected by having the crank pin engage one of the two longitudinally spaced, contoured slots. When the crank pin engages, and moves, within one of the two slots selected, rotation of the crank pin will cause the bolt to extend, or retract, within its bolt housing.

Preferably, the contours of the slots can be visualized by imagining them to be in the shape of a boot having a shank, a heel, and a toe. When the bolt is retracted, the crank pin will rest in the heel of the boot, and when the bolt is fully extended, the crank pin will rest in the toe of the boot.

In accordance with another aspect of the invention, the bolt housing is provided with two lateral apertures, which are adapted to be engaged by a spring loaded ball bearing within the bolt so as to additionally secure the bolt from movement within the bolt housing at the extremes of its retracted and extended positions.

In accordance with yet another aspect of the invention, the lock comprises both an inner and outer assembly (that is inside the door and outside the door) including facilities for registering the inside and outside assemblies one to the other and keep them from rotation with respect to one another to thereby facilitate easy and relatively goof proof installation in the field.

In accordance with yet another aspect of the invention, a "thumbturn only" embodiment of the invention is disclosed in which a bar secures the crank and pin assembly to the thumbturn housing assembly.

In a yet further embodiment of the invention, adapters are provided for installation of the door lock assembly of the invention in doors that are thicker than standard.

The foregoing and other objects, features and advantages of the invention will be apparent from the following more particular description of a preferred embodiment thereof, as illustrated in the accompanying drawings, in which all like parts are identically numbered.

DETAILED DESCRIPTION

Figure 1:
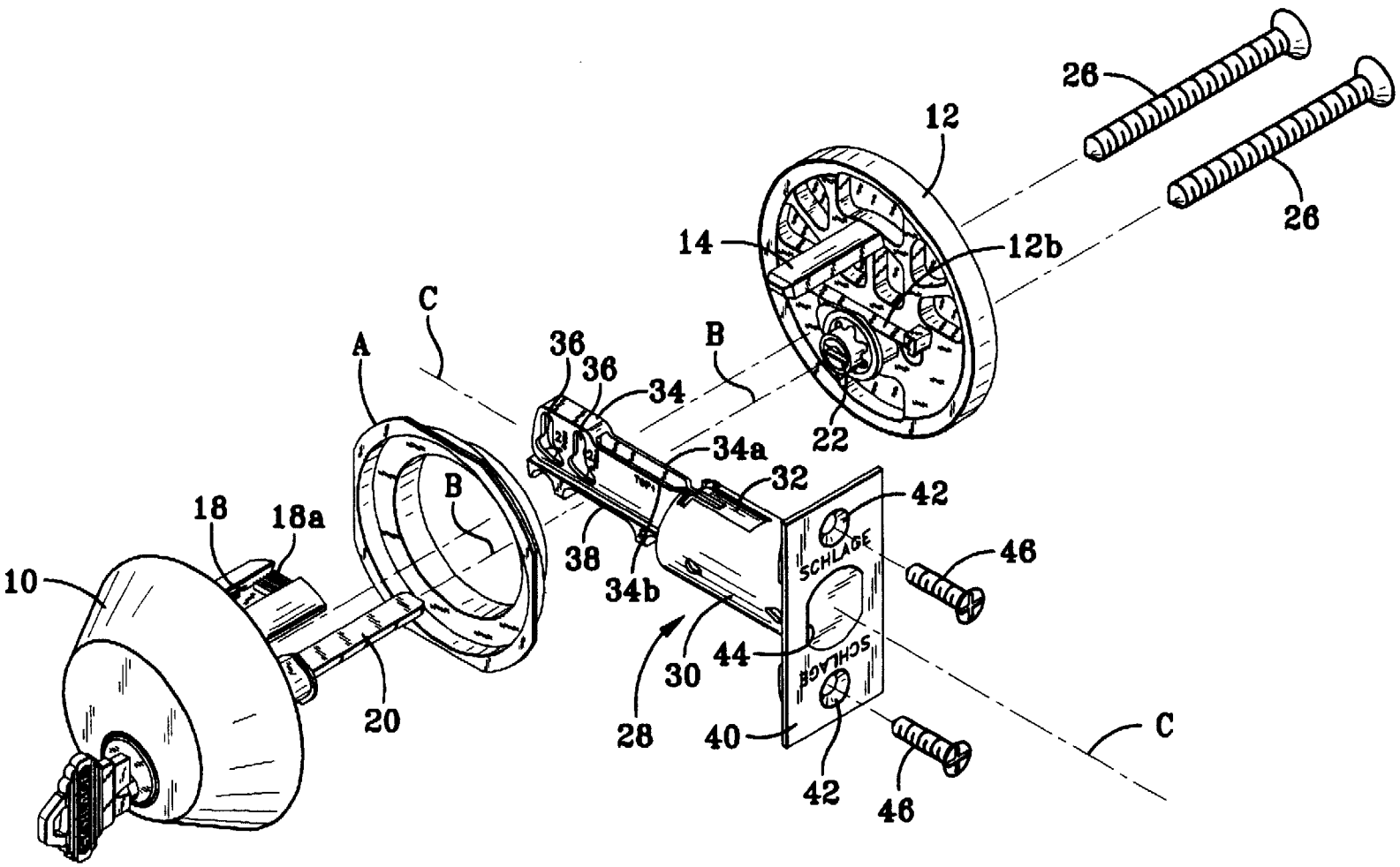
FIG. 1 is an exploded perspective view showing relevant parts of a door lock assembly in accordance with the invention.

As shown in FIG. 1, the door lock assembly in accordance with the invention comprises a bolt assembly 28, an outside assembly 10 (on one side of the door, not shown), and an inside assembly 12. A tab 14 projects from the inside assembly 12 and is adapted to mate with a projecting member 16 having a slot 18 adapted to receive tab 14. A friction fit insert **18*a* (made of some synthetic material, such as polypropylene) retains tab 14 once tab 14 has been inserted in slot 18 upon assembly of the assemblies 10 and 12**.

A male tab 20 (coupled for rotation with a key 24 through an otherwise conventional mechanism, not shown) is adapted to be inserted in a slot 22 of the inside assembly 12 so that rotation of either a key 24 or a thumbturn (not shown) in FIG. 1 (but shown in FIG. 2 as element 52) will cause rotation of the tab 20 about an axis B—B.

Figure 3:
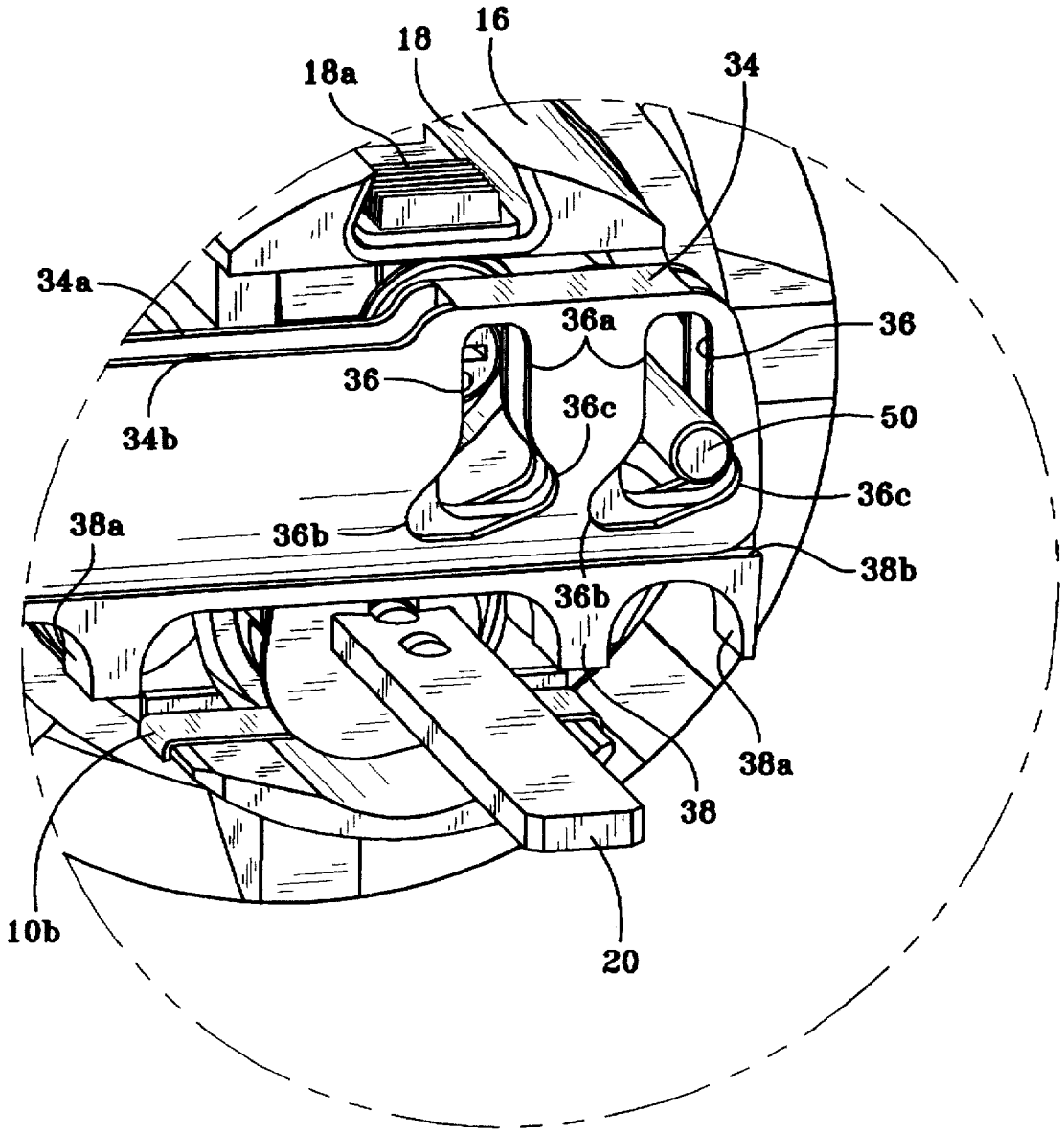
FIG. 3 is an exploded perspective view, in expanded scale, showing the cooperation between the rotating pin and the slots in the bolt extension saddle in accordance with the invention.

Screws 26 are provided to secure the inside and outside assemblies to the door. A bolt assembly, generally indicated at 28, comprises a bolt housing 30 in which a bolt 32 is adapted to move axially along its own length. Rigidly fastened to the bolt 32 is a bolt extension 34 in the form of a saddle having dependent lateral skirts 34*a* and 34*b*, as shown in FIGS. 1 and 3.

Each of the saddle skirts 34*a* and 34*b* have contoured slots 36 formed therein in which a portion 36*a* can be characterized as the shank of a boot, and in which there is also formed a toe 36*b* and a heel 36*c*. Note that the bottom elevation of the (in side view) toe 36*b* is lower than the bottom elevation of the heel 36*c*.

A housing guide 38 is adapted to be fitted into a slot 30*c* of bolt housing 30 so that, once inserted in housing 30, it is adapted to guide the bolt extension saddle 34 for axial movement in the bolt housing 30 along axis C—C. It is noted that axis B—B is transverse to axis C—C. The housing guide 38 is provided in its nether portion with two cutouts 38*a* for the mounting screws 26 and also exhibits a ledge 38*b* on which the bolt extension saddle 34 rides while it is axially moved to retract or extend the bolt 32.

A bolt plate 40 has apertures 42 and a bore 44 for passage of the bolt 32 between its extended and retracted positions. Screws 46 fasten the plate 40 (and the lock assembly as will be later described) with respect to the edges of the door. An otherwise conventional adaptor ring A ensures that the outside lock assembly 10 will fit into the appropriate door lock bore size.

Figure 2:
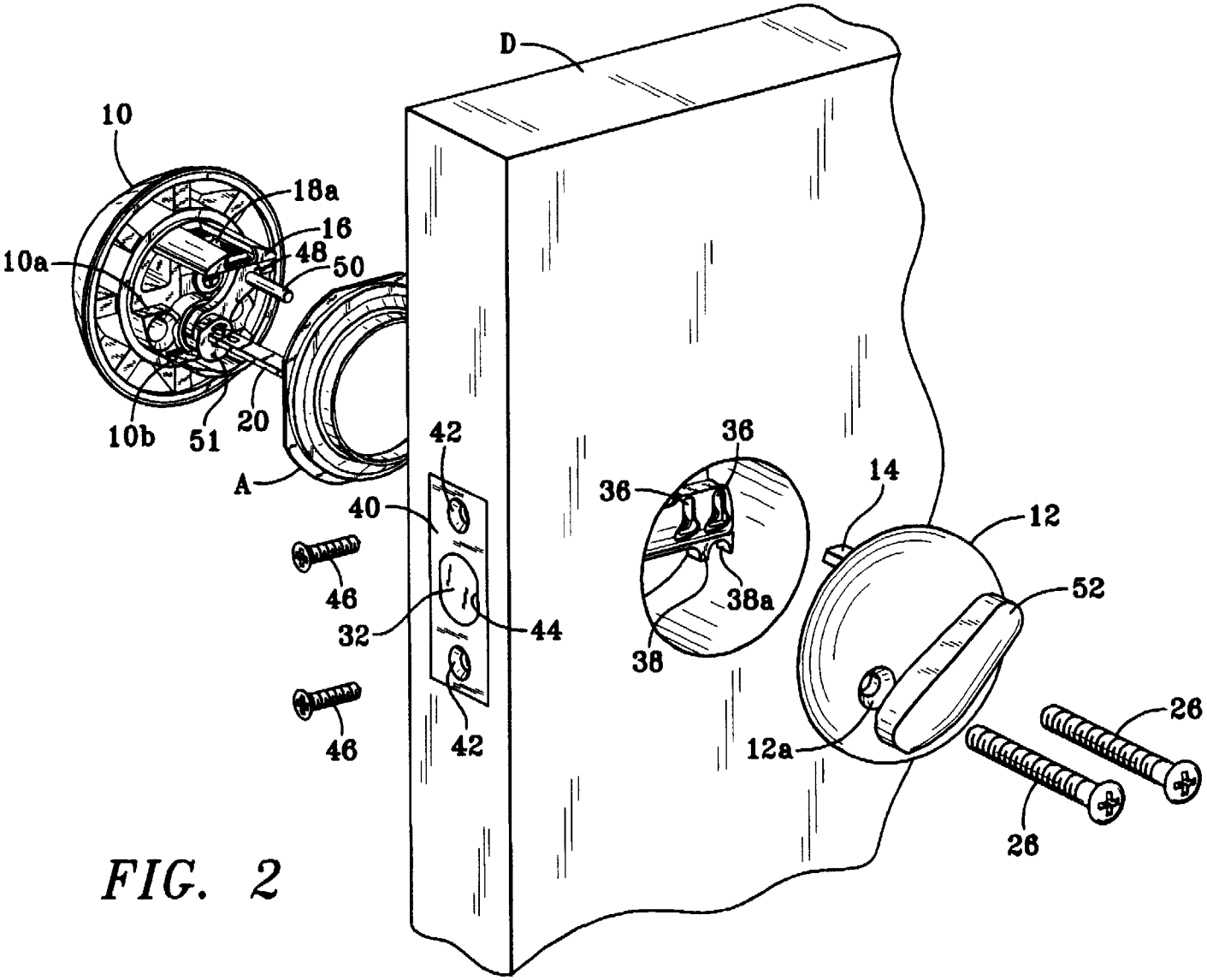
FIG. 2 is an exploded perspective view showing other details of the door lock assembly in accordance with the invention.

With reference now particularly to FIG. 2, there is shown a door D and the inside and outside assemblies 10 and 12. Coupled for rotation by either a key 24 or a thumbturn 52 to tab 20 is a crank 48 having a crank pin 50 connected for rotation therewith.

Furthermore, the crank 48 is secured longitudinally along tab 20 by a removable retainer 51. A leaf spring 10*b* extends beneath the crank 48 and retainer 51, which fit together and have two flats that act as a cam, to prevent rotational slop of the crank 48 when the door lock is actuated. The retainer has a lip on the lower outside edge to keep the spring in place.

As further shown in FIG. 2, the inside assembly 12 has formed therein two bores 12*a*(of which only one is shown) which receive the fastening screws 26 for assembly of the lock in a door D. A leaf spring 12*b* is also attached to the inside assembly 12 to serve a similar function as leaf spring 10*b* on the outside assembly 10, i.e. to prevent rotational free play in the rotating slot mechanism 22.

With reference to FIG. 3, there is shown an enlarged view illustrating the bolt extension saddle 34 having formed on both sides thereof depending skirts 34*a* and 34*b*. Two identical slots 36 are formed in guide 34 which are in the form of a boot having a shank 36*a*, a toe 36*b* and a heel 36*c*. Crank pin 50 will project through the depending skirts 34*a* and 34*b* and ride in the slots 36 formed therein. When the bolt 32 is fully retracted, crank pin 50 will rest against the contours of the heel 36*c* of bolt extension saddle 34. When the bolt 32 is fully extended, crank pin 50 will rest in the toe 36*b* of the slot 36. Note that in this resting place of the fully extended bolt, pin 50 rests in such a position that any attempted backward movement of the bolt assembly will fully ledge pin 50 in between the toe slot 36*b*, and the housing guide tabs 38*c*. Thus, the configuration of slot 36 additionally secures the pin and bolt assembly from further motion.

Figure 4:
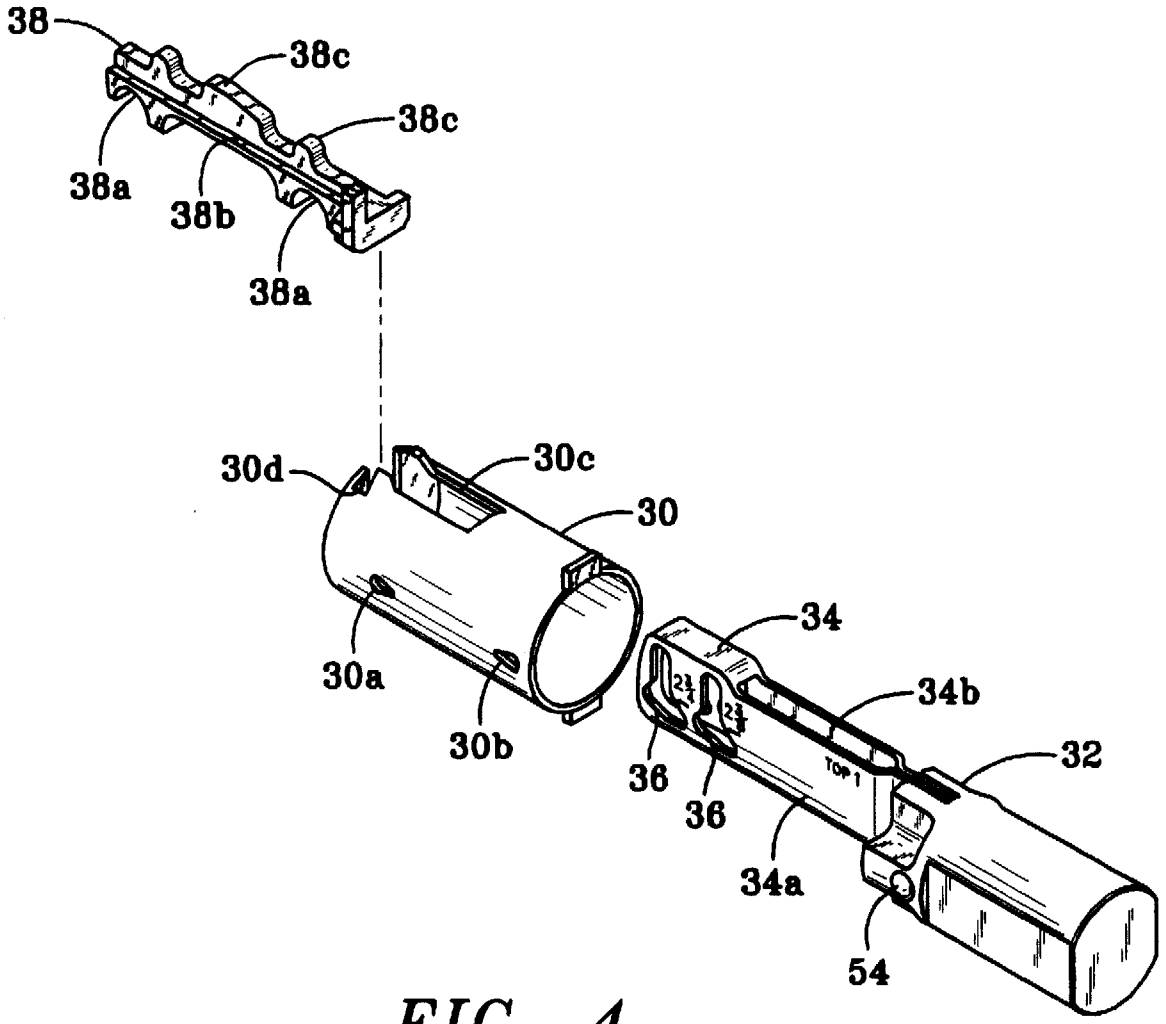
FIG. 4 is an exploded perspective view showing the bolt housing, a bolt and bolt extension, and the housing guide in accordance with the door lock assembly of the invention.

Reference to FIG. 4 shows the bolt 32 having rigidly fastened thereto the bolt extension saddle 34. Both slip within the housing 30 which is provided with two lateral openings 30*a* and 30*b*. A spring loaded ball bearing 54 in bolt 32 will engage aperture 30*a* when the bolt assembly is fully retracted and aperture 30*b* when the bolt is fully extended. The cooperation between spring loaded ball bearing 54 and apertures 30*a* and 30*b* thus insures further stability of bolt location and prevention of unnecessary movement when the bolt is fully retracted or extended. A slot 30*c* provides clearance for assembling bolt extension saddle 34 into bolt housing 30.

The shape of the boot is such that it pushes the pin down into the housing guide tabs to lock the bolt in the extended or retracted position.

As also shown in FIG. 4, the housing guide 38 is provided with semi-circular cutouts 38*a* so that the screws 26 (shown in FIG. 1) can pass therethrough to secure the inside assembly 12 to the outside 10 with each other and the door D, the latter shown in FIG. 2. The cutouts 38*a*, prevent the bolt assembly from coming out of the door when the screws 26 are installed.

Figure 6:
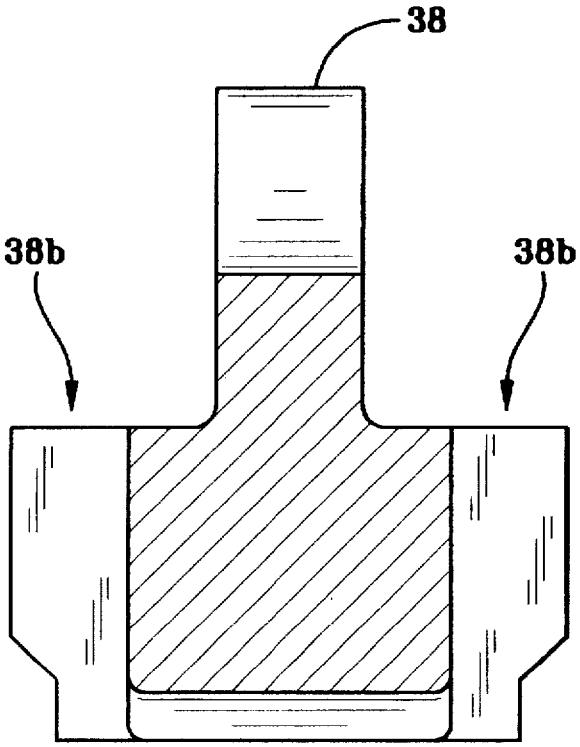
FIG. 6 is a cross sectional end view of the housing guide in a door lock assembly of the invention.

As also further shown in FIG. 4, the housing guide 38 is a separate piece adapted to fit within a vertical slot 30*d* of the innermost end of bolt housing 30. Once the housing guide 38 is inserted in slot 30*d*, the housing guide will keep the bolt 32 from rotation about its longitudinal axis and will also guide the bolt extension saddle 34 axially along its ledges 38*b*, shown more particularly in FIG. 6.

Figure 7:
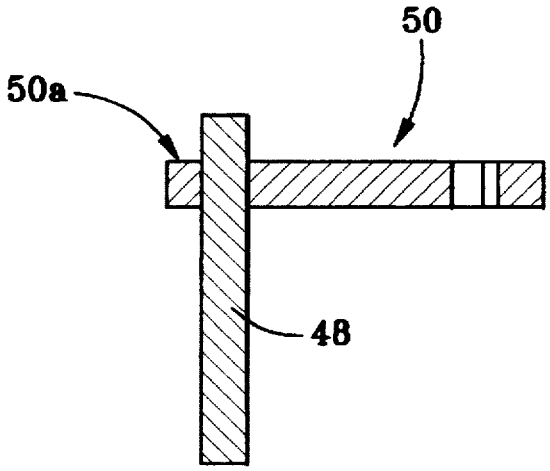
FIG. 7 is a cross sectional side view of the crank and crank pin of a door lock assembly in accordance with the invention.

As shown in FIG. 7, the crank 48 has projecting therethrough a crank pin 50 having an extended portion 50*a* for engaging ledge 10*a* (shown in FIG. 2) to limit rotation of the crank 48 about its rotational axis. A similar ledge 10*a* (not shown) formed on the outside assembly 10 prevents rotation beyond a certain point in the clockwise direction (as shown in FIG. 2).

Figure 5:
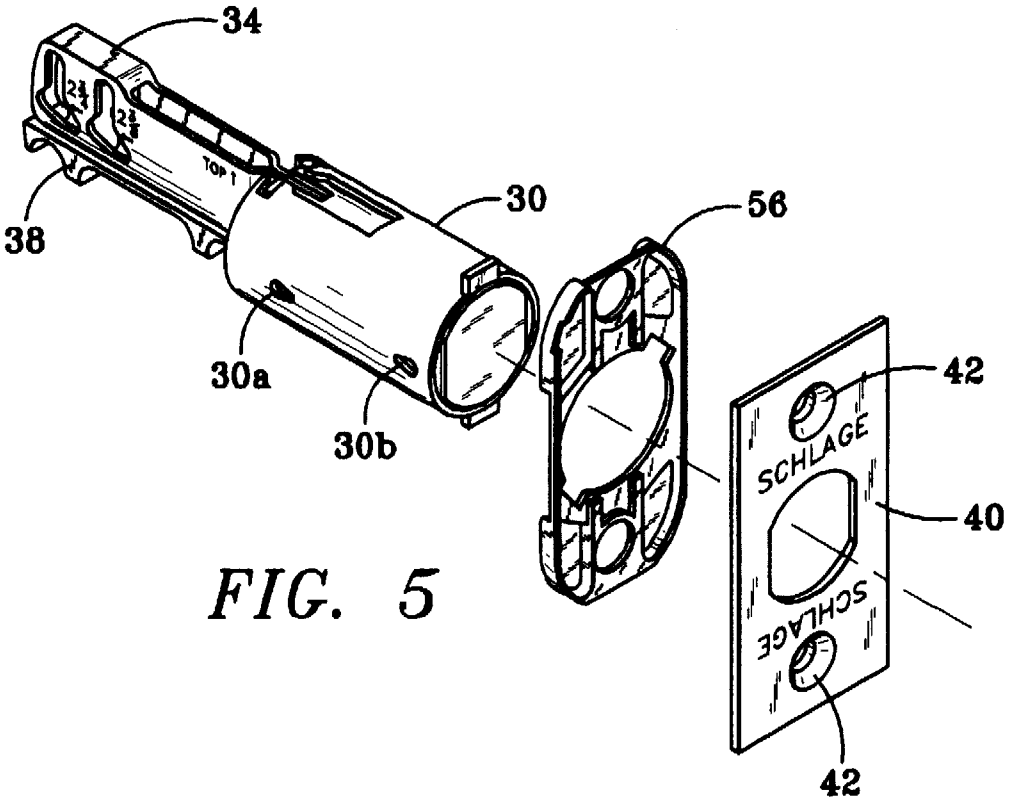
FIG. 5 is another exploded perspective view showing portions of a door lock assembly in accordance with the invention.

As further shown in FIG. 5, a retainer plate 56 is shown so as to receive the bolt housing 30 and locate it with respect to the edge of the door when the entire lock assembly is fully installed in a door.

Figure 8:
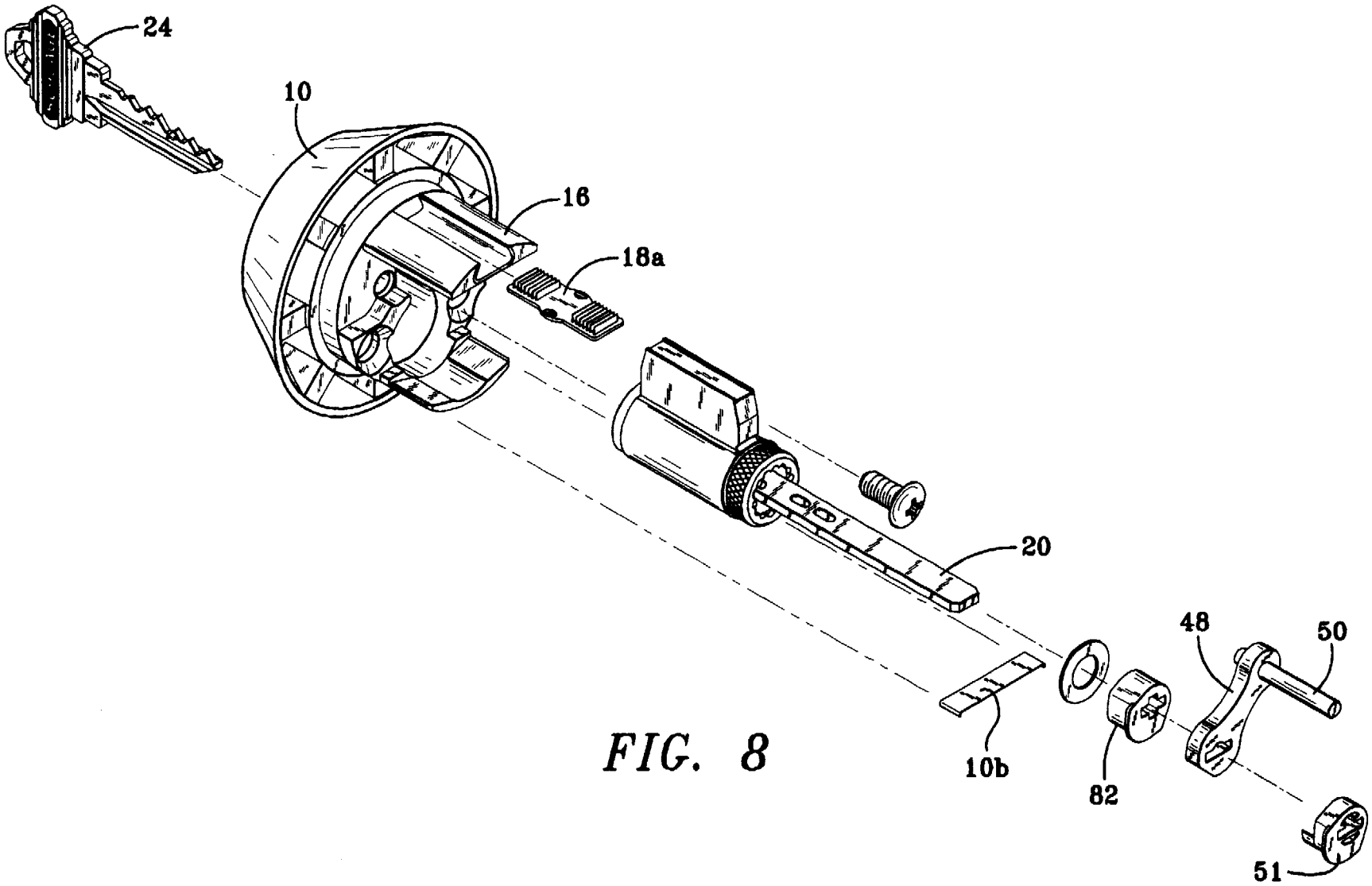
FIG. 8 is an exploded perspective view of the door lock mechanism but disclosing additional details, especially parts along the axis of rotation of the crank for doors that are thicker than standard. In this view only emphasized parts, not previously shown or described, are numbered.

With respect to FIG. 8, it shows various parts of the door lock mechanism according to the invention, with special attention to a crank spacer 82 which serves to space the previously identified crank and pin upon the male tab 20. This crank spacer 82 is efficacious for spacing the crank and pin further along the male tab 20 when a door thicker than standard is involved in the installation of a lock.

Figure 9:
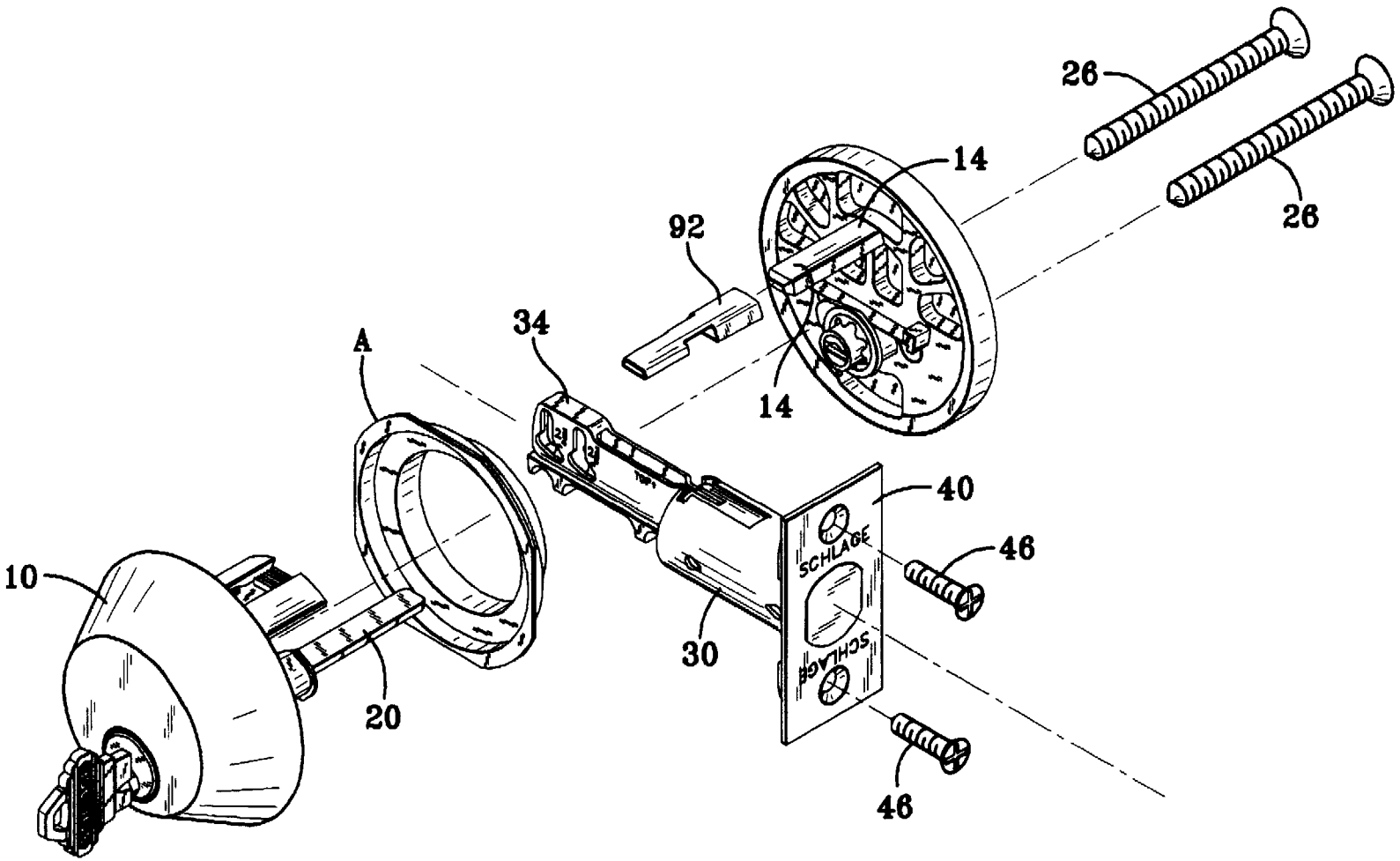
FIG. 9 is an exploded perspective view of the door lock mechanism but disclosing additional details, especially parts along the axis of rotation of the crank for doors that are thicker than standard. In this view only emphasized parts, not previously shown or described, are numbered.

FIG. 9 also shows a thick door adapter 92 cooperating with the tab 14 to extend the reach thereof when a door thicker than standard calls for a lock installation.

Figure 10:
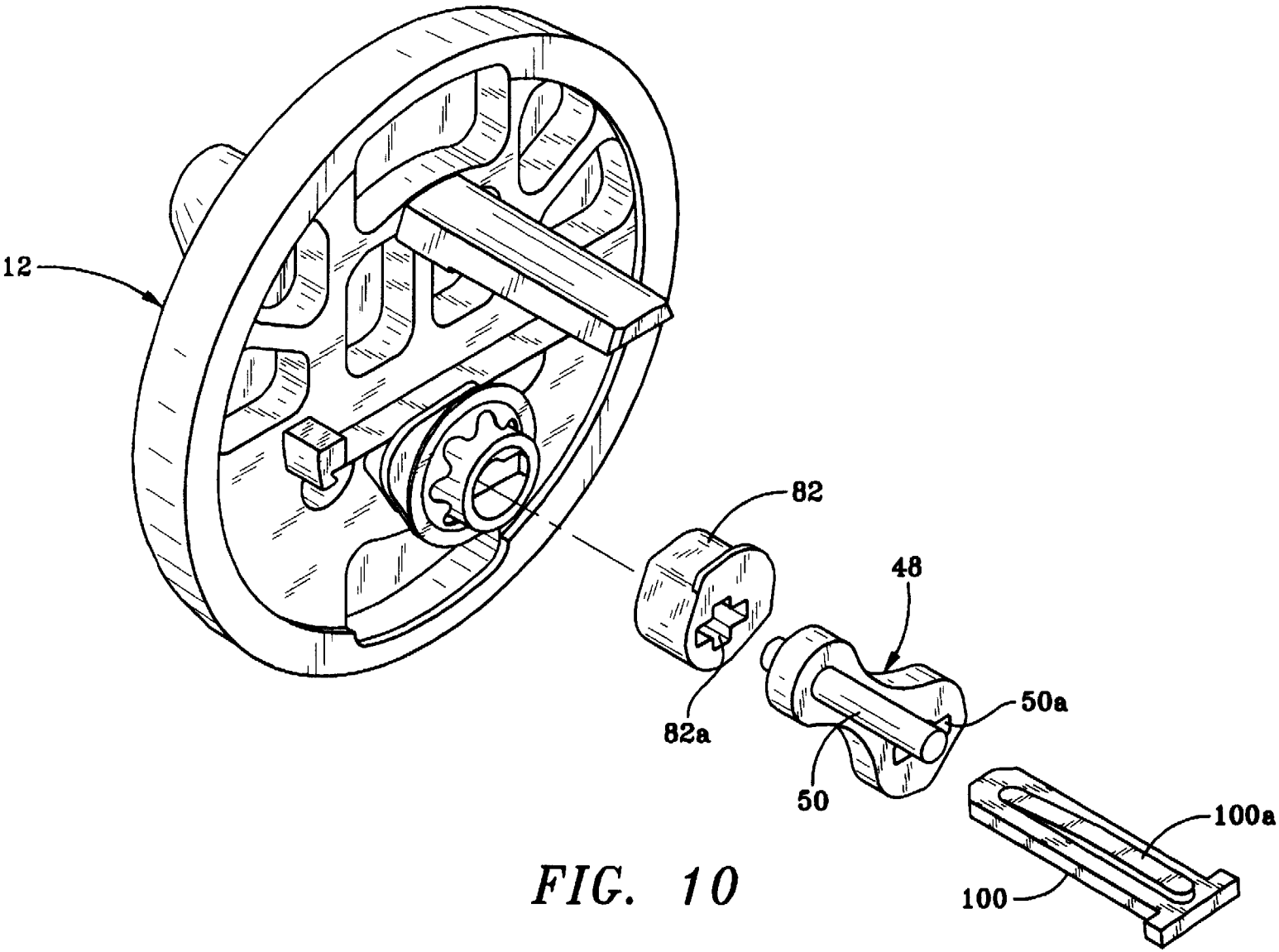
FIG. 10 is an exploded perspective view of parts of a door lock mechanism involving a "thumbturn-only" embodiment of the invention. In this view only emphasized parts, not previously shown or described, are numbered.

With reference to FIG. 10, in addition to previously identified parts, there is shown a wedge bar 100 which is used in those embodiments of the invention in which only a single thumbturn opens or closes the door. In such an assembly, there is a need to register crank 48 and pin 50 to the thumbturn housing assembly and this is achieved by assembling the lock with a bar 100 which is designed to pass through an opening 50*a* of the crank 48 and, if appropriate, through an opening 82*a* of the crank spacer 82, to secure the crank and pin assembly (48,50) to the thumbturn and housing assembly. The bar 100 has at least one raised portion 100*a* to guarantee a strong wedge, or friction, fit to secure the crank to the thumbturn.

Figure 11:
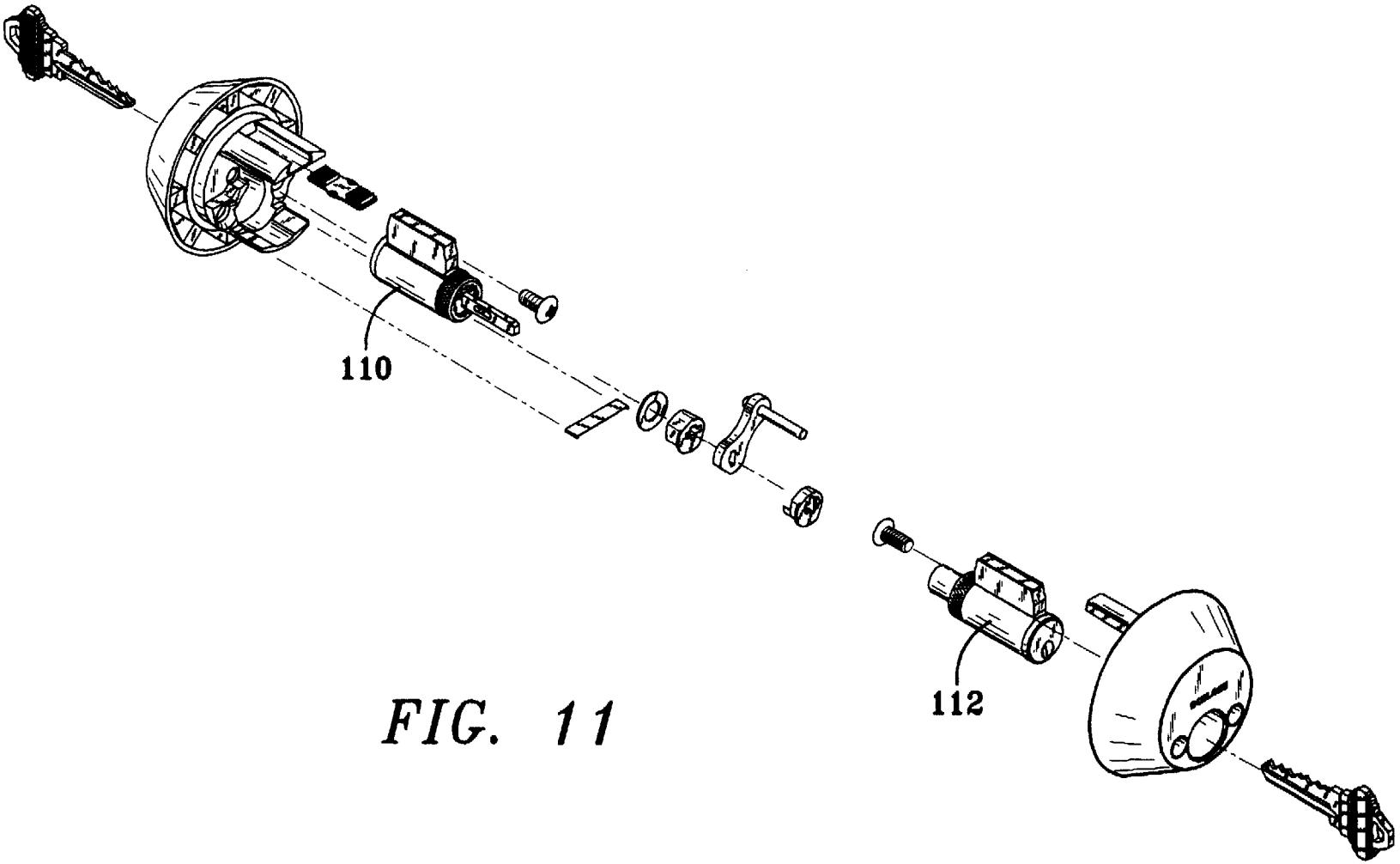
FIG. 11 is an exploded perspective view of parts of a door lock mechanism involving a double cylinder embodiment of the invention. In this view only emphasized parts, not previously shown or identified, are numbered.

With reference to FIG. 11, various parts of the door lock according to the invention are illustrated but only the new parts are numbered. These parts comprise a first cylinder 110 and a second cylinder 112 for those embodiments of the invention in which both the inside and outside cylinder and housing assembly are operated with keys. The remaining parts of the invention are otherwise as shown and described in FIGS. 1 through 10.

Figure 12:
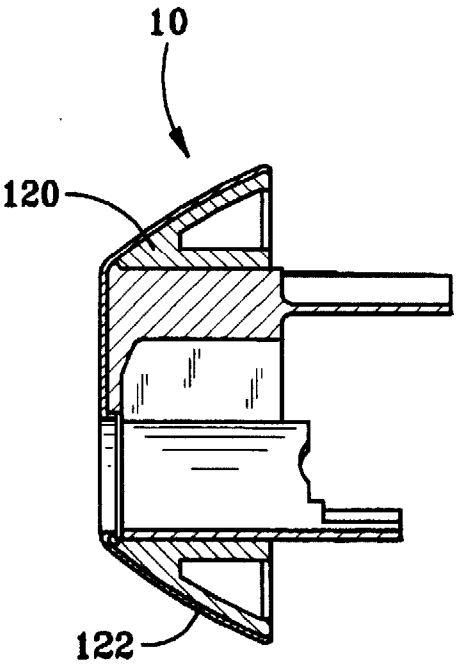
FIG. 12 is a cross-sectional view of an outside housing cylinder with a slip ring.

With reference to FIG. 12, the outside assembly 10 is preferably surrounded around its circumference by a slip ring 120 that is, in turn, covered with a cover 122. The slip ring 120 allows rotation between the outer cover and the outside cylinder housing 125 so that, if, for example, a torque wrench were to be applied to the outside assembly 10 to vandalize the lock, nothing would happen to the lock itself. The vandal would merely be rotating the cover 122 and the slip ring 120 around the cylinder housing 125. To secure the cover 122 to the slip ring 120, it is crimped along the edge of slip ring 120.

While the invention has been particularly shown and described with reference to preferred embodiments thereof, it will be understood by those skilled in the art that other changes in form and details may be made therein without departing from the spirit and scope of the invention, as defined by the claims appended hereto.

We claim:

1. A multiple backset door lock assembly comprising:

a) a bolt having a first end and a second end and having a longitudinal axis, defined as a first axis, the bolt being adapted to be moved along the first axis to a fully retracted or a fully extended position;

b) a longitudinal bolt housing being adapted to receive the bolt for axial movement therein, the housing having a first and a second end;

c) a housing guide affixed to the first end of the bolt housing and fixed both axially and rotationally with respect thereto, the housing guide having an axially extending ledge formed thereon;

d) a bolt extension saddle fixed to the first end of the bolt, the saddle having skirts depending therefrom and resting on, and guided along, the first axis by the ledge;

e) a plurality of contoured slots formed in the skirts in the form of a boot, the boot having a toe and a heel;

f) a rotatable crank retained on a tab extending transversely to the first axis, the crank having a crank pin adapted to engage one of the plurality of slots depending on which back-set is selected whereby rotation of the crank pin about an axis transverse to the first axis causes the pin to move in the slot and move the bolt along the first axis to a fully extended or fully retracted position.

2. A multiple backset door lock assembly according to claim 1 in which the pin rests in the toe portion of the slot when the bolt is fully extended.

3. A multiple backset door lock assembly according to claim 1 in which the pin rests in the heel portion of the slot when the bolt is fully retracted.

4. A multiple backset door lock assembly according to claim 1 wherein the toe of the boot has a bottom elevation that is lower than the bottom elevation of the heel of the boot.

5. A multiple backset door lock assembly according to claim 1 wherein the plurality of slots are spaced axially along the first axis in the skirts.

6. A multiple backset door lock assembly according to claim 1 wherein the bolt housing has lateral apertures found therein and the bolt has a lateral spring loaded ball bearing adapted to engage the lateral apertures in the fully extended or fully retracted position.

7. A multiple backset door lock assembly according to claim 1 further including an inner lock assembly adapted to be mounted on the inside of the door and an outer lock assembly to be mounted on the outside of the door and wherein the inner and outer lock assemblies are registered with one another by a tab on one of the lock assemblies mating with a slot on the other of the lock assemblies.

8. A multiple backset door lock assembly according to claim 7 wherein the slot in one of the lock assemblies has inserted therein a friction fit material.

9. A multiple backset door lock assembly according to claim 1 further including an inner lock assembly adapted to be mounted on the inside of the door and an outer lock assembly to be mounted on the outside of the door and a first leaf spring to restrain rotational loose play of the crank and pin assembly, the first leaf spring being mounted on the outside lock assembly.

10. A multiple backset door lock assembly according to claim 9 further including a second leaf spring to restrain rotational loose play of a thumbturn and bar on which the crank and pin assembly is mounted, the second leaf spring being mounted on the inside lock assembly.

11. A multiple backset door lock assembly according to claim 8 wherein the outer lock assembly has formed therein at least one ledge to restrain rotational movement of the crank pin.

12. A multiple backset door lock assembly according to claim 1 further including an inner lock assembly adapted to be mounted on the inside of the door and an outer lock assembly to be mounted on the outside of the door and two key cylinders, one on the inside, the other on the outside lock assembly.

13. A multiple backset door lock assembly according to claim 1 wherein the door lock assembly is mounted on a door having an inside surface and an outside surface and further including a thumbturn assembly on the inside surface of the door with the crank and pin attached to the thumbturn, and nothing on the outside surface of the door.

14. A multiple backset door lock assembly according to claim 7 in which the outer lock housing is surrounded by a slip ring, the slip ring being covered by a cover crimped around edges of the slip ring so that attempted vandalism by trying to torque the outside lock assembly merely rotates the slip ring.

15. A multiple backset door lock assembly comprising:

a) a bolt having a first end and a second end and having a longitudinal axis, defined as a first axis, the bolt being adapted to be moved along the first axis to a fully retracted or a fully extended position;

b) a longitudinal bolt housing being adapted to receive the bolt for axial movement therein, the housing having a first and a second end;

c) a housing guide affixed to the first end of the bolt housing and fixed both axially and rotationally with respect thereto, the housing guide having an axially extending ledge formed thereon;

d) a bolt extension saddle fixed to the first end of the bolt, the saddle having skirts depending therefrom and resting on, and guided along, the first axis by the ledge;

e) a plurality of contoured slots formed in the skirts in the form of a boot, the boot having a toe and a heel;

f) a rotatable crank retained on a tab extending transversely to the first axis, the crank having a crank pin adapted to engage one of the plurality of slots depending on which backset is selected whereby rotation of the crank pin about an axis transverse to the first axis causes the pin to move in the slot and move the bolt along the first axis to a fully extended or fully retracted position, and g) a crank spacer to locate the crank along the axis of the tab.

16. A multiple backset door lock assembly comprising:

a) a bolt having a first end and a second end and having a longitudinal axis, defined as a first axis, the bolt being adapted to be moved along the first axis to a fully retracted or a fully extended position;

b) a longitudinal bolt housing being adapted to receive the bolt for axial movement therein, the housing having a first and a second end;

c) a housing guide affixed to the first end of the bolt housing and fixed both axially and rotationally with respect thereto, the housing guide having an axially extending ledge formed thereon;

d) a bolt extension saddle fixed to the first end of the bolt, the saddle having skirts depending therefrom and resting on, and guided along, the first axis by the ledge;

e) a plurality of contoured slots formed in the skirts in the form of a boot, the boot having a toe and a heel;

f) a rotatable crank retained on a tab extending transversely to the first axis, the crank having a crank pin adapted to engage one of the plurality of slots depending on which backset is selected whereby rotation of the crank pin about an axis transverse to the first axis causes the pin to move in the slot and move the bolt along the first axis to a fully extended or fully retracted position, and g) an adapter for doors thicker than standard comprising an extension cooperating with a tab mounted a cylinder assembly.

* * * * *